US010286293B2

(12) United States Patent
Riordan et al.

(10) Patent No.: US 10,286,293 B2
(45) Date of Patent: May 14, 2019

(54) AUTOMATIC PLAYING CARD SHUFFLER AND OTHER CARD-HANDLING DEVICES INCORPORATING IMAGE CAPTURING DEVICES, NON-IMAGING SENSORS, MICRO-VISION SYSTEMS AND/OR EMBEDDED SYSTEMS TO DETECT UNDESIRABLE MARKINGS ON PLAYING CARDS

(71) Applicant: Shark Trap Gaming & Security Systems, LLC, Las Vegas, NV (US)

(72) Inventors: Michael Earnest Riordan, Las Vegas, NV (US); Louis Wilson DeGregorio, Las Vegas, NV (US); Dino Louis DeGregorio, Las Vegas, NV (US); Steven Louis Forte, Las Vegas, NV (US)

( * ) Notice: Subject to any disclaimer, the term of this patent is extended or adjusted under 35 U.S.C. 154(b) by 0 days.

(21) Appl. No.: 15/866,254

(22) Filed: Jan. 9, 2018

(65) Prior Publication Data

US 2018/0126254 A1 May 10, 2018

Related U.S. Application Data

(63) Continuation-in-part of application No. 15/336,779, filed on Oct. 27, 2016, now Pat. No. 9,943,751, which (Continued)

(51) Int. Cl.
*A63F 1/12* (2006.01)
*A63F 9/24* (2006.01)

(52) U.S. Cl.
CPC ..... *A63F 1/12* (2013.01); *A63F 2009/2425* (2013.01); *A63F 2250/287* (2013.01); *A63F 2250/58* (2013.01)

(58) Field of Classification Search
None
See application file for complete search history.

(56) References Cited

U.S. PATENT DOCUMENTS 5,605,334 A 2/1997 McCrea, Jr.
5,707,287 A 1/1998 McCrea, Jr.
(Continued)

OTHER PUBLICATIONS

International Preliminary Report on Patentability, dated Nov. 21, 2014 (14 pages).
(Continued)

*Primary Examiner* — Jay Liddle
*Assistant Examiner* — Alex F. R. P. Rada, II
(74) *Attorney, Agent, or Firm* — FisherBroyles, LLP; Rob L. Phillips

(57) ABSTRACT

An automatic playing card shuffler incorporating cameras, non-imaging sensors, embedded systems and/or micro-vision systems for detecting anomalies and undesired markings on playing cards. Combinations of cameras, non-imaging sensors, embedded systems and/or micro-vision systems integrated in or proximate to automatic playing cards shufflers collect images and card information for analysis to determine if anomalies and undesired markings on playing cards are indicative of a scam or worn cards, or provide skilled players with an advantage to determine if anomalies and undesired markings on playing cards are indicative of a scam, unintentional, or the result of normal manufacturing variances, which could provide skilled players with an advantage.

35 Claims, 9 Drawing Sheets

Related U.S. Application Data is a continuation-in-part of application No. 15/001,039, filed on Jan. 19, 2016, now Pat. No. 9,776,072, which is a continuation-in-part of application No. PCT/US2014/047227, filed on Jul. 18, 2014.

(60) Provisional application No. 61/847,710, filed on Jul. 18, 2013.

(56) References Cited

U.S. PATENT DOCUMENTS

| | | | | |
|---|---|---|---|---|
| 6,726,205 | B1 * | 4/2004 | Purton | A63F 1/14 273/148 R |
| 7,959,153 | B2 | 6/2011 | Franks, Jr. | |
| 9,316,597 | B2 | 4/2016 | Blazevic | |
| 2001/0054576 | A1 | 12/2001 | Stardust | |
| 2004/0026636 | A1 | 2/2004 | Shigeta | |
| 2005/0242500 | A1 | 11/2005 | Downs, III | |
| 2006/0279040 | A1 | 12/2006 | Downs, III et al. | |
| 2007/0102879 | A1 * | 5/2007 | Stasson | A63F 1/12 273/149 R |
| 2008/0006998 | A1 | 1/2008 | Grauzer | |
| 2008/0113783 | A1 * | 5/2008 | Czyzewski | A63F 3/00157 463/29 |
| 2009/0066021 | A1 | 3/2009 | Shigeta | |
| 2009/0286597 | A1 | 11/2009 | Shigeta | |
| 2009/0291758 | A1 | 11/2009 | Moretti et al. | |
| 2010/0314834 | A1 | 12/2010 | Shigeta | |
| 2010/0327525 | A1 | 12/2010 | Shigeta | |
| 2011/0285082 | A1 | 11/2011 | Krenn et al. | |
| 2012/0306152 | A1 | 12/2012 | Krishnamurty et al. | |
| 2013/0307215 | A1 | 11/2013 | Shigeta | |
| 2014/0027979 | A1 | 1/2014 | Stasson | |
| 2014/0346733 | A1 | 11/2014 | Shigeta | |
| 2014/0347471 | A1 * | 11/2014 | Blazevic | G01N 21/8806 348/128 |
| 2015/0373284 | A1 | 12/2015 | Blazevic | |

OTHER PUBLICATIONS

International Preliminary Report on Patentability, dated Oct. 7, 2014 (13 pages).

International Preliminary Report on Patentability, dated Jan. 22, 2015 (14 pages).

* cited by examiner

AUTOMATIC PLAYING CARD SHUFFLER AND OTHER CARD-HANDLING DEVICES INCORPORATING IMAGE CAPTURING DEVICES, NON-IMAGING SENSORS, MICRO-VISION SYSTEMS AND/OR EMBEDDED SYSTEMS TO DETECT UNDESIRABLE MARKINGS ON PLAYING CARDS

CROSS-REFERENCES

This application is a continuation-in-part of U.S. patent application Ser. No. 15/336,779 filed Oct. 27, 2016 which is a continuation-in-part of U.S. patent application Ser. No. 15/001,039 filed Jan. 19, 2016, now U.S. Pat. No. 9,776,072, which is a continuation of PCT Application No. PCT/US2014/047227 filed Jul. 18, 2014 and U.S. patent application Ser. No. 61/847,710 filed Jul. 18, 2013 from which PCT Application No. PCT/US2014/047227 claims priority, all of which are incorporated herein by reference for any and all purposes.

FIELD OF THE INVENTION

The embodiments of the present invention relate to an automatic playing card shuffler and other card-handling devices incorporating one or more cameras with one or more non-imaging sensors to detect anomalies and undesirable markings on playing cards. Micro-vision systems, embedded systems, and non-imaging sensors may also be used alone or in combination with one or more cameras to augment the core system to handle, for example, specific tasks. The embodiments of the present invention are useful to maintain the integrity of casino games.

BACKGROUND

Cheats and advantage players have been around as long as gambling. With the advancement of technology, come new methods for cheats and advantage players to work against casinos. One such method involves marking playing cards such that cheats may discern a card's identity (i.e., value and suit) from the card back. Knowing the value and suit provides the cheat with a tremendous advantage over the casino (e.g., blackjack) or competing players (e.g., poker). Intentionally marking playing cards can take many forms including, but not limited to, the use of invisible chemicals viewable through special lenses, the use of chemicals only viewable via electronic means and physical demarcations. Unintentional card markings include, but are not limited to, anomalies, smudges, manufacturing defects, etc. As suggested, advantage players take advantage of available information rather than intentionally marking cards. For example, advantage players may use manufacturing defects with the playing cards to create an advantage (e.g., edge sorting).

It would be useful and advantageous to develop an automatic playing card shuffler and other card-handling devices incorporating one or more cameras, micro-vision systems, embedded systems, and non-imaging sensors to build a complete detection system to detect anomalies and undesirable markings on playing cards to limit or prevent cheats and advantage players from gaining an edge against casinos.

SUMMARY

Accordingly, one embodiment of the present invention comprises: an automatic playing card shuffler incorporating means for detecting marked cards. Automatic playing card shufflers have been around for approximately 25 years and are now ubiquitous in the casino industry. Automatic playing card shufflers speed up games, generate reliable, random card shuffles and combat card counters. Automatic playing card shufflers use electromechanical technologies to randomly re-arrange one or more decks of playing cards for use in casino games. The embodiments of the present invention may be integrated into any automatic playing card shuffler.

In one embodiment of the present invention, an automatic playing card shuffler incorporates a camera in combination with one or more non-imaging sensors to detect card anomalies and undesirable markings. For example, a non-imaging sensor can be a very small, discrete, pass/fail device like a 'luster sensor' that detects the difference between specular and diffusive reflection, which can detect the presence of foreign substances, shiny spots, alterations to the finish, etc.

In another embodiment of the present invention, an automatic playing card shuffler incorporates a camera in combination with one or more embedded vision systems (i.e., board cameras) to detect card anomalies and undesirable markings. An embedded system includes a small camera (no housing), interface and a small circuit board (no housing). These systems are small, inexpensive, and flexible, require low power and are generally designed for specific tasks.

In another embodiment of the present invention, an automatic playing card shuffler incorporates one or more non-imaging sensors and one or more embedded vision systems to detect card anomalies and undesirable markings.

In another embodiment of the present invention, an automatic playing card shuffler incorporates two or more embedded vision systems to detect card anomalies and undesirable markings.

In another embodiment of the present invention, an automatic playing card shuffler incorporates two or more embedded vision systems with one or more non-imaging sensors to detect card anomalies and undesirable markings.

In another embodiment of the present invention, an automatic playing card shuffler incorporates a micro-vision system to detect card anomalies and undesirable markings.

Other variations, embodiments and features of the present invention will become evident from the following detailed description, drawings and claims.

DETAILED DESCRIPTION

Figure 1A:
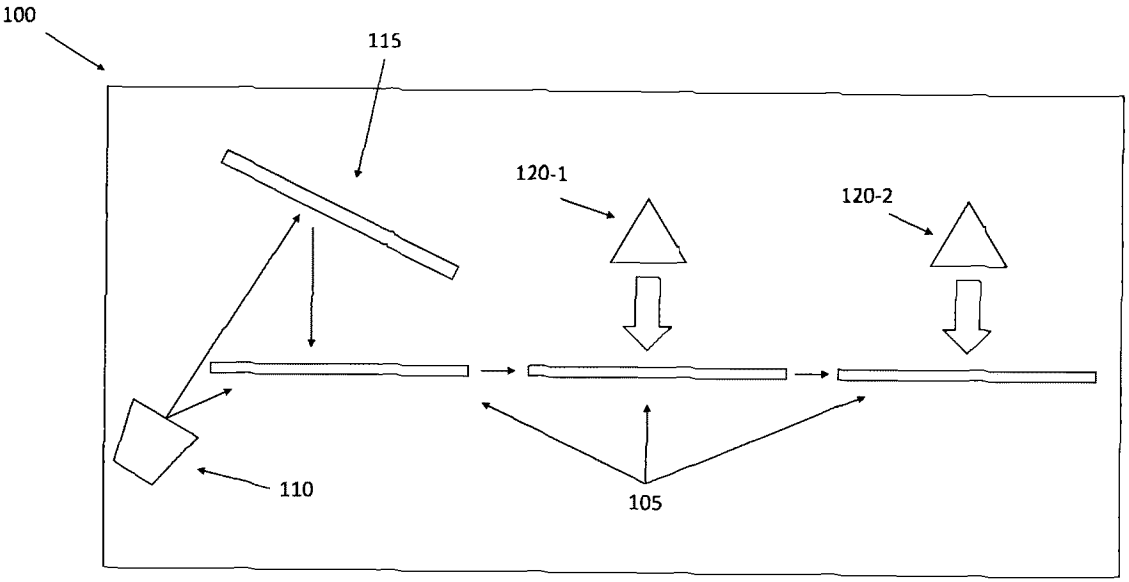
FIG. 1A illustrates a block diagram of an automatic playing card shuffler incorporating a camera in combination with a pair of non-imaging sensors to detect card anomalies and undesirable markings on playing cards moving through the automatic card shuffler according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to those skilled in the relevant art and having possession of this disclosure, are to be considered within the scope of the invention claimed.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.), or an embodiment combining software and hardware. Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), and optical storage device, a magnetic storage device, or any suitable combination of the foregoing. In the context of this document, a computer readable storage medium may be any tangible medium that can contain or store a program for use by or in connection with an instruction execution system, apparatus, or device.

A computer readable signal medium may include a propagated data signal with computer readable program code embodied thereon, for example, in baseband or as part of a carrier wave. Such a propagated signal may take any variety of forms, including, but not limited to, electromagnetic, optical, or any suitable combination thereof. A computer readable signal medium may be any computer readable medium that is not a computer readable storage medium and that can communicate, propagate, or transport a program for use by or in conjunction with an instruction execution system, apparatus, or device.

Program code embodied on a computer readable medium may be transmitted using any appropriate medium, including but not limited to wireless, wireline, optical fiber cable, RF and the like, or any suitable combination of the foregoing.

Computer program code for carrying out operations for aspects of the present invention may be written in any combination of one or more programming languages, including an object oriented programming language such as Java, Smalltalk, C++ or the like or conventional procedural programming languages, such as the "C" programming language, AJAX, PHP, HTML, XHTML, Ruby, CSS or similar programming languages. The programming code may be configured in an application, an operating system, as part of a system firmware, or any suitable combination thereof. The programming code may execute entirely on the user's computer, partly on the user's computer, as a standalone software package, partly on the user's computer and partly on a remote computer or entirely on a remote computer or server as in a client/server relationship sometimes known as cloud computing. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer-implemented process such that the instructions which execute on the computer or other programmable apparatus provide processes for implementing the functions/acts specified in the flowchart and/or block diagram block or blocks. As used herein, a "computer" should be understood to be any one of a general purpose computer, as for example a personal computer or a laptop computer, a client computer configured for interaction with a server, a special purpose computer such as a server, or a smart phone, soft phone, tablet computer, personal digital assistant or any other machine adapted for executing programmable instructions in accordance with the description thereof set forth above.

Any automatic playing card shuffler (e.g., single deck, multi-deck, batch, random-position, random-selection, etc.), card verification device and card cancellation device is suitable for, and may benefit from, the embodiments of the present invention. Depending on the type, automatic playing card shufflers use mechanical and electromechanical components such as rollers, elevators, bins, ejectors, motors, stepper motors, pulleys, carousels, pushers, etc., to transport and randomly organize an unshuffled group of playing cards into a shuffled group of playing cards.

The embodiments of the present invention involve the use of various cameras and/or sensors to identify cards by value and suit, and card anomalies and undesirable card markings on the identified cards. As used herein, a camera may be any device capable of capturing a card image including, but not limited to, area scan cameras, smart cameras, line scan cameras, monochrome cameras, 3D cameras, high speed recording cameras, video cameras, contact image sensors, embedded vision systems (aka board cameras), spectral cameras and IR/UV cameras. As used herein, a sensor is any non-imaging device, capable of detecting desirable information from playing cards useful in determining the presence of anomalies and undesirable markings including, but not limited to, luster sensors, contrast sensors, brightness sensors, surface sensors, depth sensors, color sensors, laser sensors, 3D sensors and IR/UV sensors. As used herein, embedded vision systems or board cameras are systems comprising a board camera (no housing), interface and processing board (no housing) designed for application-specific tasks. Primary benefits of the embedded vision systems are their small size, low weight, low power consumption, low price and versatility. As used herein, micro-vision systems are complete computer vision systems of the type integrated into smart cameras. Various combinations of the cameras, sensors and/or micro-vision systems facilitate the embodiments of the present invention whereby anomalies and undesirable card markings can be detected. For example, in one embodiment, the automatic playing card shuffler incorporates a camera with one or more non-imaging sensors. In such an embodiment, the camera captures the card value and suit while the sensors are designed to collect specific information related to one or more specific anomalies or undesirable marks associated with the backs of the playing cards.

FIG. 1A shows a block diagram of an automatic playing card shuffler 100 incorporating a camera 110 and mirror 115 in combination with one or more non-imaging sensors 120-1 and 120-2 to detect card anomalies and undesirable markings on moving playing cards according to the embodiments of the present invention. In this embodiment, the camera 110 and mirror 115 capture images of the back and face of each playing card 105 while the non-imaging sensors 120-1, 120-2 are positioned to act on a back of each playing card 105 as each playing card 105 moves (in direction of arrows) past each of the camera 110 and two sensors 120-1, 120-2. Sensor 120-1 may be a luster sensor to detect reflective differences in card sheen, gloss, shine, etc., while sensor 120-2 may be a contrast sensor to detect differences in contrast on the back of each playing card 105. A difference in card sheen, gloss or shine and contrast may be indicative of a card marking scam or worn cards. The image of the back of each playing card 105 with the information collected by the sensors 120-1, 120-2 can be evaluated by a processor running executable instructions and/or software module to determine the presence of anomalies and undesirable markings.

Figure 1B:
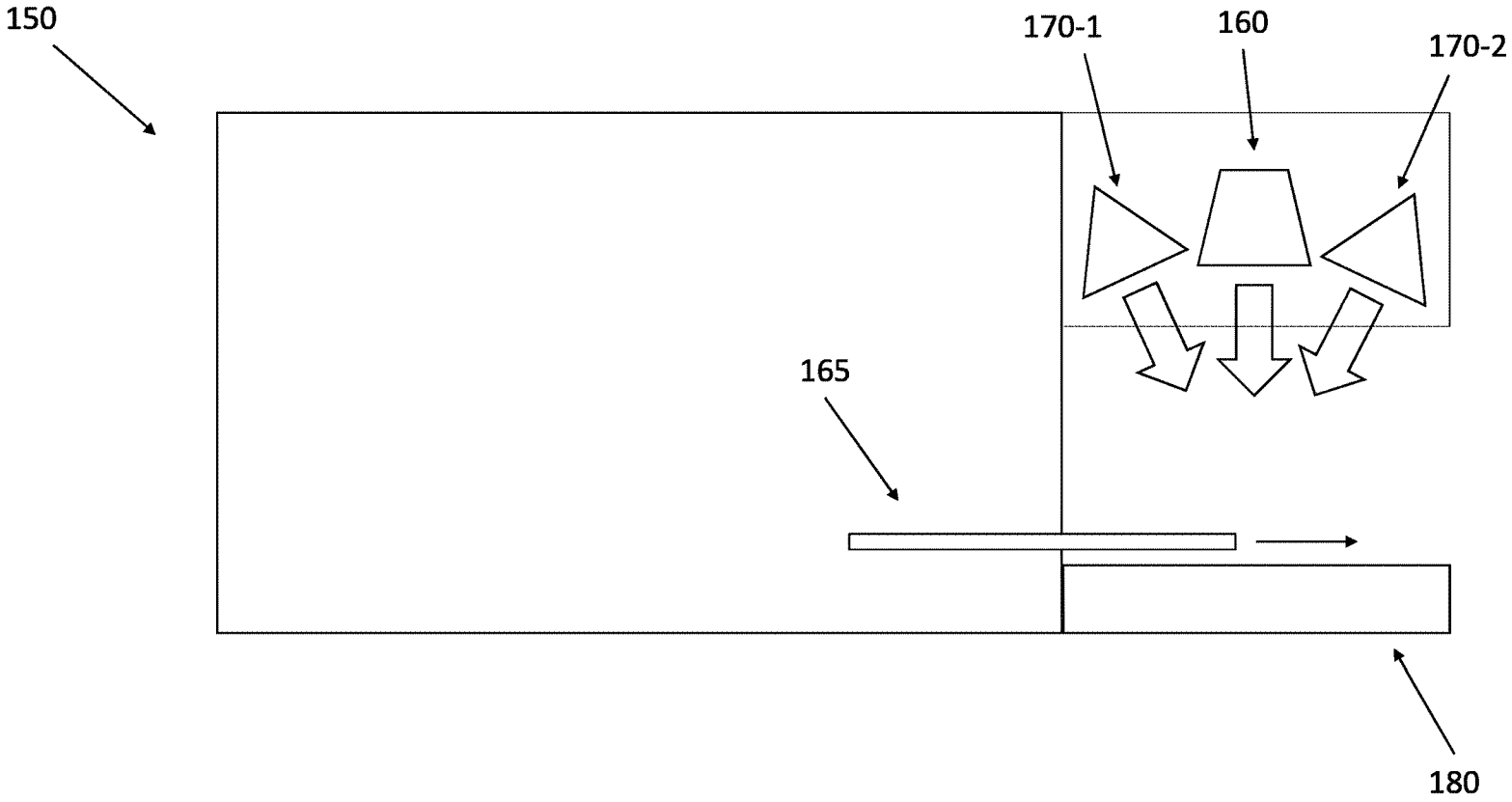
FIG. 1B illustrates a block diagram of an automatic playing card shuffler incorporating a camera in combination with a pair of non-imaging sensors to detect card anomalies and undesirable markings on stationary playing cards according to the embodiments of the present invention.

FIG. 1B shows a block diagram of an automatic playing card shuffler 150 incorporating a camera 160 in combination with two non-imaging sensors 170-1, 170-2 to detect card anomalies and undesirable markings on stationary playing cards according to the embodiments of the present invention. In this embodiment, camera 160 and two non-imaging sensors 170-1, 170-2 are positioned to act on a back of a stationary playing card 165. The playing card 165 may be stationary while in a pre-shuffle bin, post-shuffle bin or selectively during the shuffling process. For example, as shown in FIG. 1B, the camera 160 and two non-imaging sensors 170-1 through 170-2 may be positioned above a post-shuffle bin 180 which receives each playing card 165 having undergone the shuffling process. After each playing card 165 completes the shuffling process of the automatic playing card shuffler 150, each playing card 165 is moved to, and comes to rest in, the post-shuffle bin 180 where the camera 160 captures a card image and the two non-imaging sensors 170-1, 170-2 detect information before a next card is moved into the post-shuffle bin 180 and stacked on the previous playing card. A second camera or mirror may be incorporated to capture an image of the card face either while moving or stationary.

Figure 2:
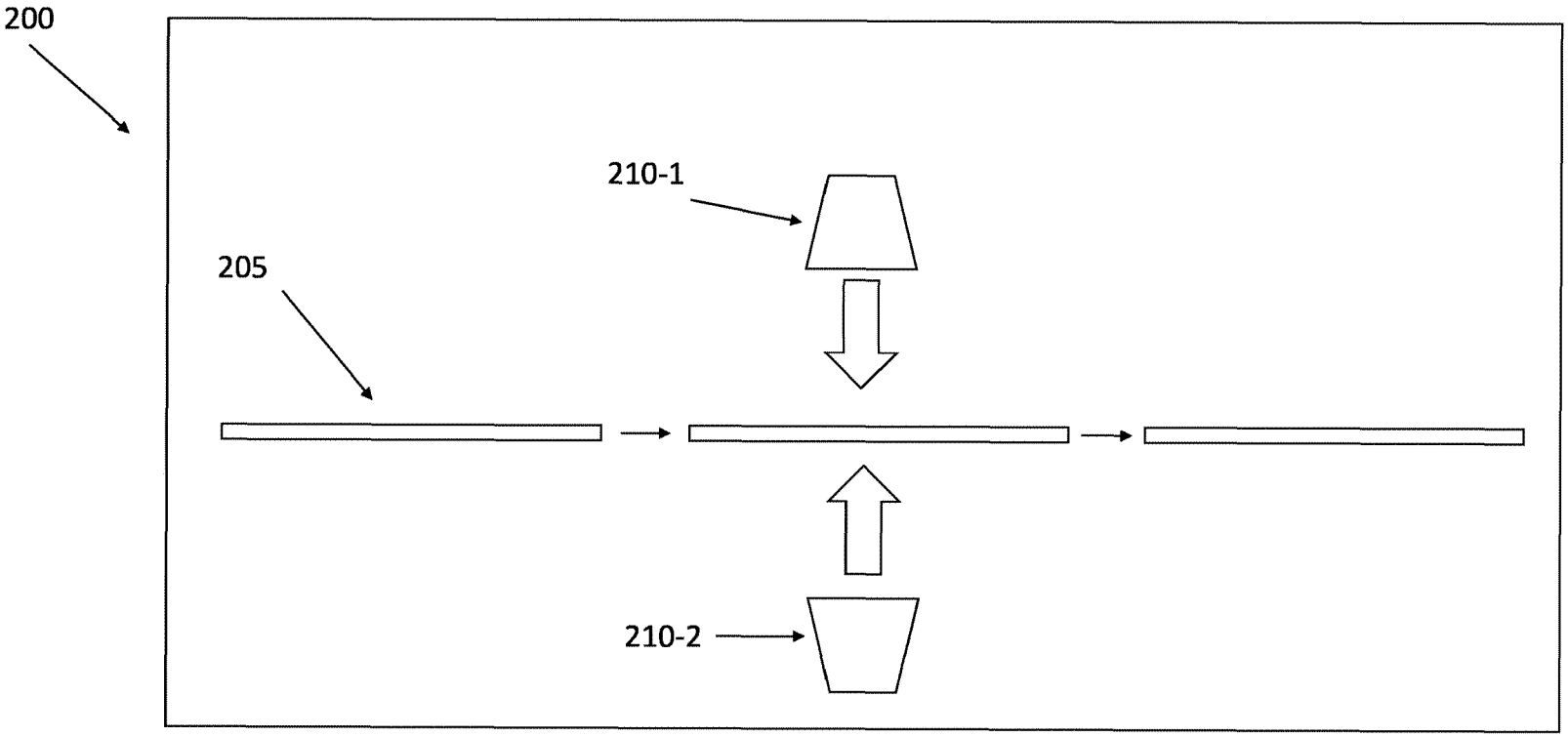
FIG. 2 illustrates a block diagram of an automatic playing card shuffler incorporating a pair of cameras to detect card anomalies and undesirable markings on playing cards according to the embodiments of the present invention.

FIG. 2 shows a block diagram of an automatic playing card shuffler 200 incorporating multiple cameras 210-1, 210-2 to detect card anomalies and undesirable markings on moving playing cards according to the embodiments of the present invention. In one embodiment, camera 210-1 is an area scan camera and camera 210-2 is a board camera (i.e., embedded vision system) having a camera, interface and processor board (i.e., circuit board). In this embodiment, camera 210-1 is positioned to capture an image of a back of playing card 205 and camera 210-2 is positioned to capture an image of a face of the playing card 205 as the playing card 205 moves (in direction of arrows) between each of the cameras 210-1, 210-2.

Figure 3:
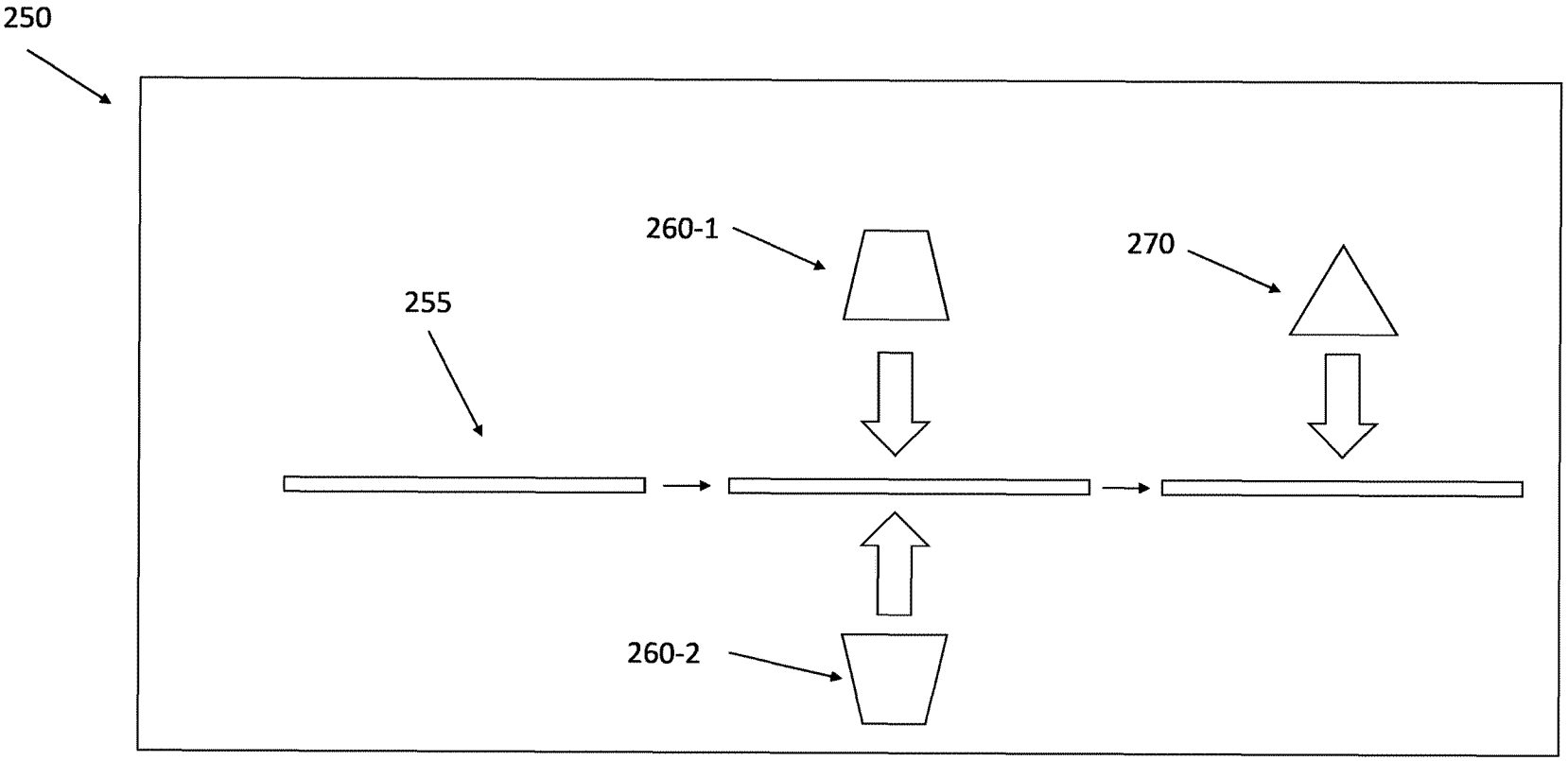
FIG. 3 illustrates a block diagram of an automatic playing card shuffler incorporating a pair of cameras and a non-imaging sensor to detect card anomalies and undesirable markings according to the embodiments of the present invention.

FIG. 3 shows a block diagram of an automatic playing card shuffler 250 incorporating a pair of cameras 260-1, 260-2 and a non-image sensor 270 to detect card anomalies and undesirable markings according to the embodiments of the present invention. In one embodiment, camera 260-1 is an area scan camera and camera 260-2 is a board camera (i.e., embedded vision system) and non-image sensor 270 is a luster sensor. In this embodiment, camera 260-1 is positioned to capture an image of a back of playing card 255 and camera 260-2 is positioned to capture an image of a face of the playing card 255 as the playing card 255 moves (in direction of arrows) between each of the cameras 260-1, 260-2. The luster sensor 270 then detects luster from the playing card back information as the playing card 255 passes thereunder.

Figure 4:
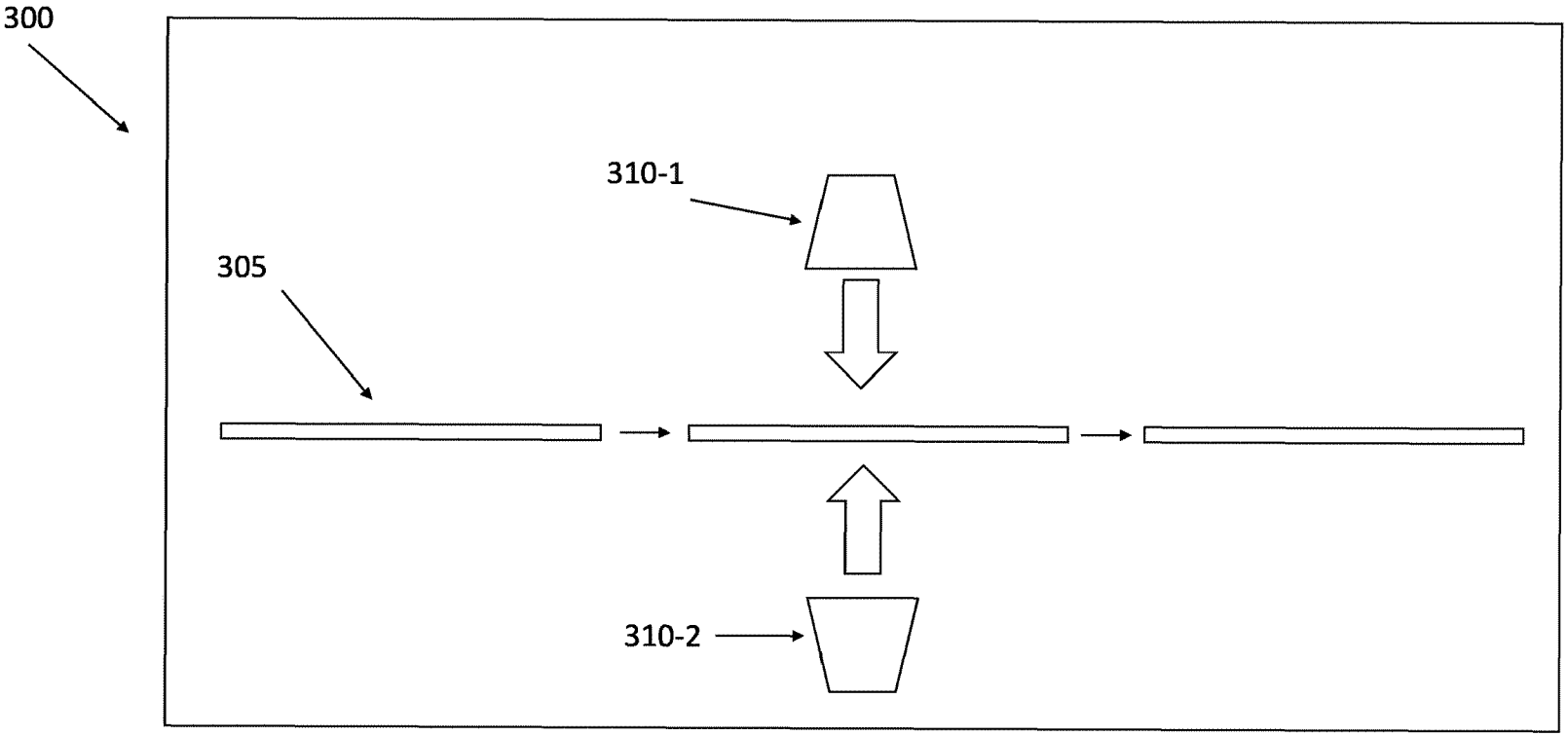
FIG. 4 illustrates a block diagram of an automatic playing card shuffler incorporating two or more embedded vision systems to detect card anomalies and undesirable markings according to the embodiments of the present invention.

FIG. 4 shows a block diagram of an automatic playing card shuffler 300 incorporating two board cameras 310-1, 310-2 to detect card anomalies and undesirable markings according to the embodiments of the present invention. In this embodiment, board camera 310-1 is positioned to capture an image of a back of playing card 355 and camera 310-2 is positioned to capture an image of a face of the playing card 315 as the playing card 315 moves (in direction of arrows) between each of the cameras 310-1, 310-2.

Figure 5:
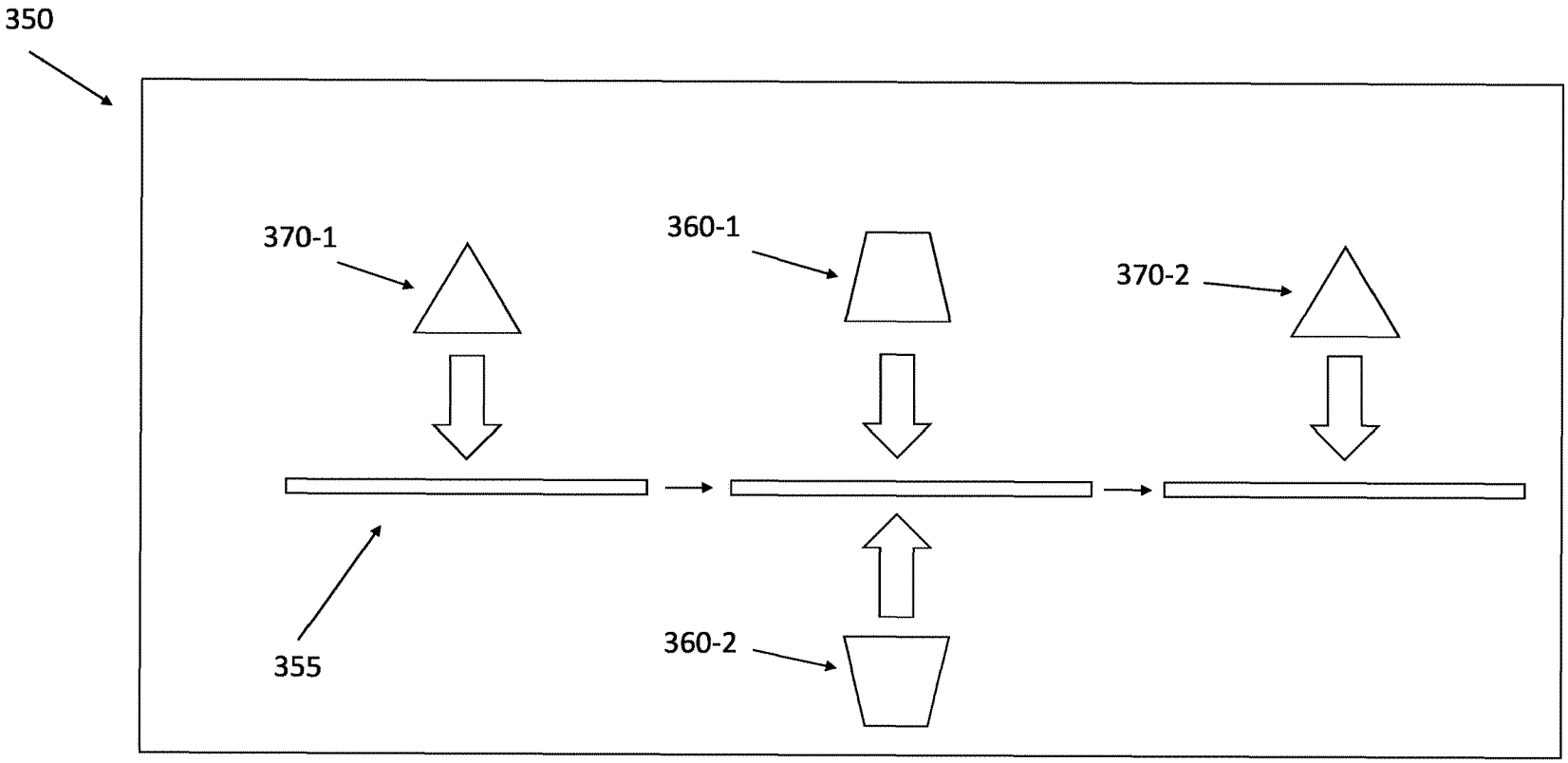
FIG. 5 illustrates a block diagram of an automatic playing card shuffler incorporating two embedded vision systems and two non-imaging sensors to detect card anomalies and undesirable markings according to the embodiments of the present invention.

FIG. 5 shows a block diagram of an automatic playing card shuffler 350 incorporating two board cameras 360-1, 360-2 and two non-imaging sensors 370-1, 370-2 to detect card anomalies and undesirable markings according to the embodiments of the present invention. In this embodiment, camera 360-1 is positioned to capture an image of a back of playing card 355 and camera 360-2 is positioned to capture an image of a face of the playing card 355 as the playing card 355 moves (in direction of arrows) between each of the cameras 360-1, 360-2. A luster sensor 370-1 then detects luster from the playing card back and color sensor 370-2 detects information as the playing card 355 passes thereunder.

Figure 6:
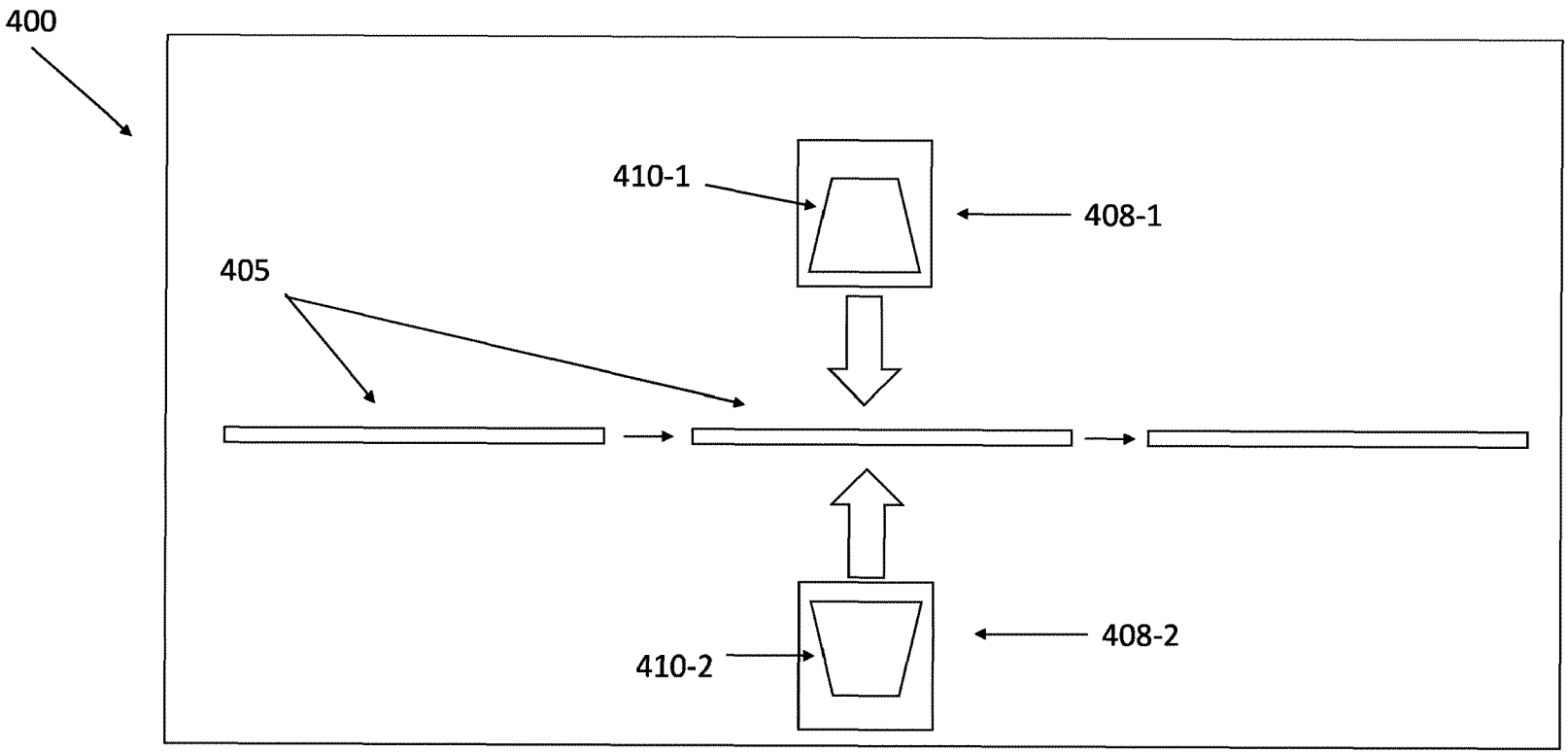
FIG. 6 illustrates a block diagram of an automatic playing card shuffler incorporating a pair of micro-vision systems to detect card anomalies and undesirable markings according to the embodiments of the present invention.

FIG. 6 shows a block diagram of an automatic playing card shuffler 400 incorporating a pair of micro-vision systems 408-1, 408-2 to detect card anomalies and undesirable markings according to the embodiments of the present invention. The micro-vision systems each comprise a camera 410-1, 410-2 positioned to capture an image of a face of a playing card 405 as the playing card 405 moves (in direction of arrows) between each of the cameras 410-1, 410-2. The cameras 410-1, 410-2 comprise complete camera systems mountable at various angles and including onboard software applications (e.g., scripting functions). Cognex of San Diego, Calif. offers micro-vision systems such as its In-Sight® Micro 8000 series smart cameras measuring 31 mm×31 mm×64 mm. Such micro-vision systems are suitable for integrating into automatic card shufflers without having to significantly increase the size thereof. Micro-vision systems may also incorporate processors, lighting and optics in relatively small housings.

Figure 7:
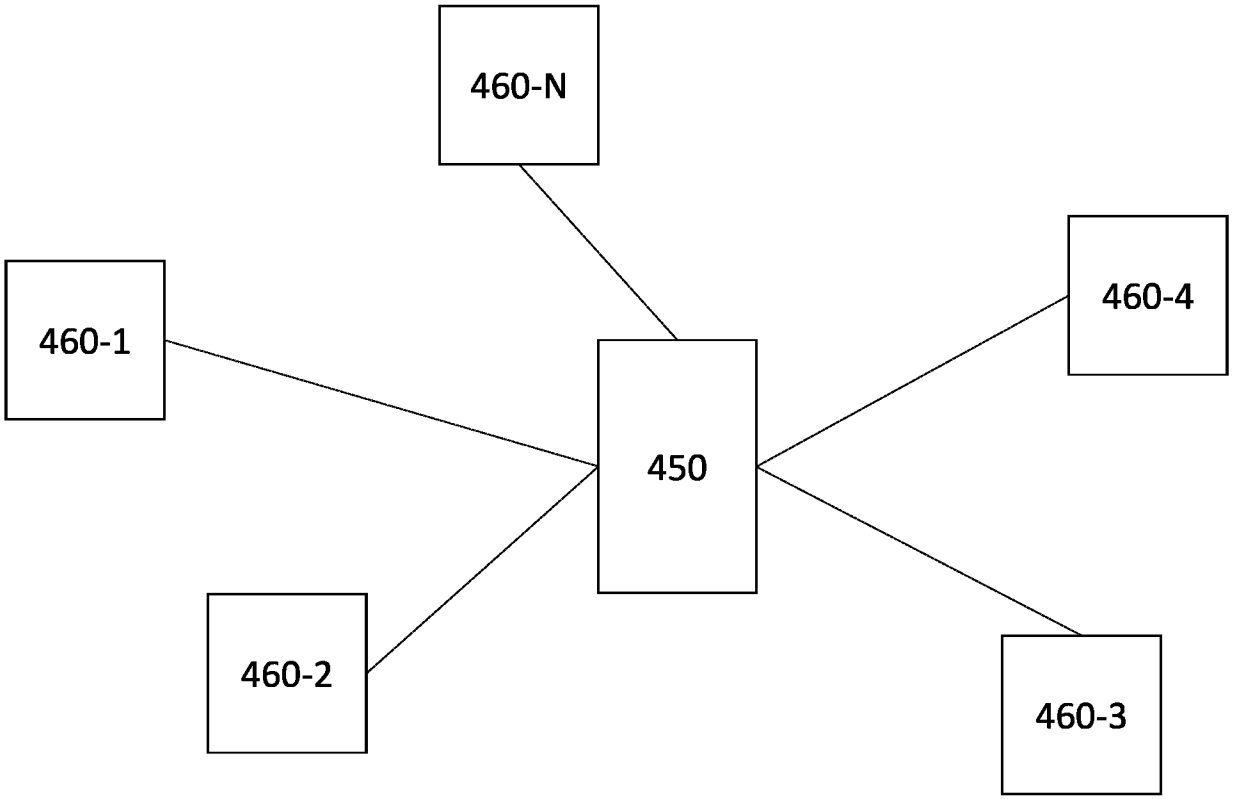
FIG. 7 illustrates a block diagram of a system comprising a plurality of automatic playing card shufflers communicatively linked to a common server according to the embodiments of the present invention.

As set forth above, various combinations of cameras, non-imaging sensors and micro-systems may be integrated into an automatic playing card shuffler to detect anomalies and undesirable card markings. The images and information collected is then evaluated by software. In one embodiment, the software is embedded in a processor or otherwise integrated into the automatic playing card shuffler. Alternatively, as shown in FIG. 7, the software may be embedded into a remote processor or otherwise integrated into a remote server 450 configured to receive images and information from a plurality of communicatively linked automatic playing card shufflers 460-1 through 460-N.

Figure 8:
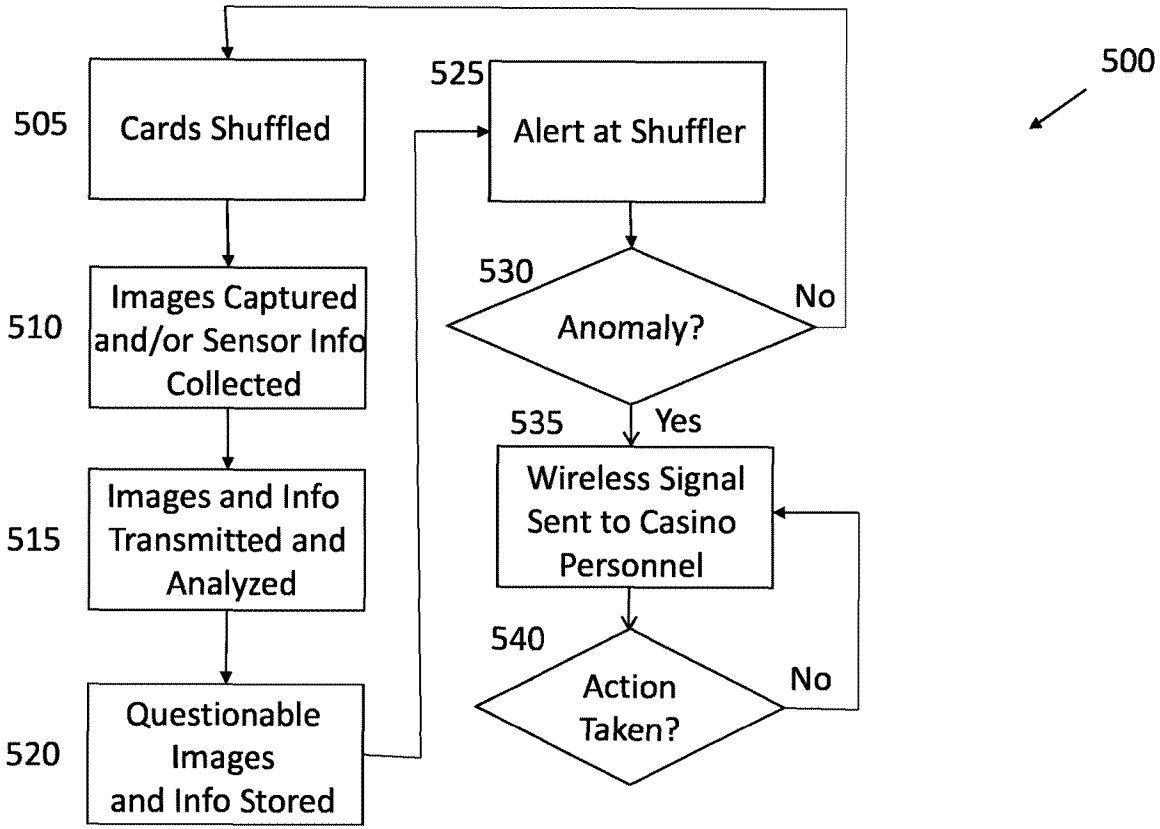
FIG. 8 illustrates a flow chart detailing operation of an automatic playing card shuffler system according to the embodiments of the present invention.

FIG. 8 shows a flow chart 500 detailing one methodology of using an automatic playing card shuffler according to the embodiments of the present invention. At 505, the automatic playing card shuffler randomly re-organizes one or more decks of playing cards via a shuffling process. At 510, as playing cards move through the automatic playing card shuffler, or when the individual playing cards are stationary, the one or more cameras, sensors and/or micro-vision systems capture images and collect information. At 515, the images and collected information are transmitted to a processor, server, computer or the like for analysis. At 520, responsive to detecting an anomaly or undesirable marking, the automatic playing card shuffler stores data in memory. In one embodiment, the data include the type of mark, and value and suit of the playing card. At 525, an automatic playing card shuffler optionally alerts the dealer to the problem. The alert may be via a display (concealed from players) incorporated in the automatic playing card shuffler or may be a wireless signal sent to a remote computer or smart device attended to by the dealer or other pit personnel. Such an alert serves to keep pit personnel attentive to a specific gaming table and a possible scam being perpetrated. At 530, it is determined if any identifiable anomalies, indicative of cheating, have been detected. For example, if multiple playing cards having undesirable marks are identified as face cards and/or Aces, it is more likely that the marks were placed intentionally. If so, at 535, a wireless message may be sent to casino personnel via the casino management system and/or security system. The wireless message may include information such as the table location, marking types and time of the discovery. At 540, it is determined if a pre-established time has elapsed with no action being taken wherein the pre-established time is triggered by the first discovery of an anomaly or undesirable marking by the automatic playing card shuffler. If so, at 535, another wireless (or wired) message may be transmitted to casino personnel via the casino management system and/or security system. This routine may continue until action is taken (e.g., cards replaced, suspect players questioned, etc.) and reported to the system by casino personnel. In another embodiment, specific casino personnel may be alerted to the card markings directly by email, SMS and/or instant messages from the automatic playing card shuffler or by email, SMS and/or instant messages triggered by the casino management system and/or security system. In other embodiments, casino personnel are alerted to all detections of marked cards immediately upon the detection.

Using the degree of anomaly, the present system can detect defects and distinguish them from other anomalies/marks by evaluating (a) the measurement's degree of anomaly, (b) consecutive-round analysis and (c) the corresponding card value. A database of defects is used to compare defects to determine the reliability of the detected defect.

Using historical data can lead to reliable conclusions. For example, after scanning ten million red-backed Bee cards from the United States Playing Card Company during a given time period, if eighteen anomalies are detected on a blackjack table at given dates and times and each anomaly is confirmed to be marked on Tens and Aces, it is apparent a scam is occurring or did occur. Such data is evidence of intentional markings.

The present system may be programmed to send a first alert or general warning that the analysis on a particular game has hit a certain threshold, which then allows casino personnel to take a closer look at the suspect game. If the action is small, it might still indicate a scam in progress, just before cheaters posing as high-rollers join the game. Indeed, round-to-round alerts can be sent to management, giving them real-time updates so they can better monitor and manage the situation. Daily summary reports may be sent to casino personnel to keep them informed as to possible scams. Overall, the system removes human decisions by providing the scientific precision and analysis of a detection system comprised of one or more cameras, micro-vision systems, embedded systems and non-imaging sensors.

In one embodiment, the shuffler system does not utilize one or more arbitrary cards—presumably legitimate—for comparison purposes (whether actual cards or database images); instead, the shuffler system uses a statistically significant sample consisting of past and present measurements to define a normal range by which to make comparisons—a sample that may exceed millions of cards. The database maintains a record of card markings such that future markings can be identified by comparison to previously identified and stored markings. This eliminates the inherent problems with using a "perfect" card for comparison purposes. Such inherent problems include all used cards being worn after a short period of time and thus indicating falsely that a scam is afoot or casino personnel conspiring with the cheating players to rig the system in advance.

The system may also identify normal wear and tear associated with shuffled playing cards so that casinos may determine when to swap out decks. This can extend the service life of playing cards and result in card-cost savings to the casinos Although the invention has been described in detail with reference to several embodiments, additional variations and modifications exist within the scope and spirit of the invention as described and defined in the following claims.

We claim:

1. An automatic card shuffling device comprising: a housing; a processor; one or more mechanisms for randomly re-arranging cards from one or more decks of playing cards; one or more cameras positioned to capture images of at least a portion of each card face allowing each card aloe to be determined during a shuffling operation; one or more non-imaging sensors positioned to detect information from each card back during a shuffling operation; one or more databases configured to store card data of said cards captured by said one or more cameras and detected by said one or more non-imaging sensors: and wherein said processor is configured to compare said stored card data captured by said one or more cameras and card data detected by said one or more non-imaging sensors with newly acquired card data of said cards captured by said one or more cameras and detected by said one; or more non-imaging sensors to detect anomalies and card markings associated with said cards.

2. The automatic card shuffling device of claim 1 wherein said one or more mechanisms are selected from one or more of the following: rollers, elevators, bins, ejectors, stepper motors and carousels.

3. The automatic card shuffling device of claim 1 wherein said one or more cameras are selected from one or more of the following: area scan cameras, smart cameras, line scan cameras, monochrome cameras, 3D cameras, high speed recording cameras, contact image sensors, board cameras, spectral cameras, color cameras, monochrome camera and IR/UV cameras.

4. The automatic card shuffling device of claim 1 wherein said one or more non-imaging sensors are selected from one or more of the following: luster sensors, contrast sensors, brightness sensors, surface sensors, depth sensors, color sensors, laser sensors, 3D sensors and IR/UV sensors.

5. The automatic card shuffling device of claim 1 further comprising one or more mirrors positioned to allow said one or more cameras to capture images of card backs, card sides and card faces.

6. The automatic card shuffling device of claim 1 further comprising electronic storage configured to maintain card images and information collected by said one or more cameras and said one or more non-imaging sensors.

7. The automatic card shuffling device of claim 1 wherein at least one of said one or more cameras have processing power.

8. The automatic card shuffling device of claim 1 wherein said one or more cameras and/or non-imaging sensors are positioned to capture card images and detect information, respectively, while said cards are moving during said shuffling operation.

9. The automatic card shuffling device of claim 1 wherein said one or more cameras and/or non-imaging sensors are positioned to capture card images and detect information, respectively, while said cards are stationary.

10. The automatic card shuffling device of claim 1 further comprising one or more micro-vision systems.

11. The automatic card shuffling device of claim 1 further comprising one or more embedded systems each including a camera, interface and a circuit board.

12. An automatic card shuffling system comprising: a plurality of automatic playing card shufflers, each automatic playing card shuffler comprising: a housing; a processor; one or more mechanisms for randomly re-arranging cards from one or more decks of playing cards; one or more cameras positioned in or proximate to said housing to capture images of at least a portion of each card face allowing each card value to be determined; one or more non-imaging sensors positioned in or proximate to said housing to detect information from each card back; and a transmitter configured to transmit images and information collected by said one or more cameras and non-imaging sensors; one or more databases configured to store card data of said cards captured by said one or more cameras and detected by said one or more non-imaging sensors; a central computer configured to receive and compare said stored card data captured by said one or more cameras and detected by said one or more non-imaging sensors with newly acquired card data of said cards captured by said one or more cameras and detected by said one or more non-imaging sensors to detect anomalies and card markings associated with said cards.

13. The automatic card shuffling system of claim 12 wherein said one or more mechanisms are selected from one or more of the following: rollers, elevators, bins, ejectors, stepper motors and carousels.

14. The automatic card shuffling system of claim 12 wherein said one or more cameras are selected from one or more of the following: area scan cameras, smart cameras, line scan cameras, monochrome cameras, 3D cameras, high speed recording cameras, contact image sensors, board cameras, spectral cameras, color cameras, monochrome cameras and IR/UV cameras.

15. The automatic card shuffling system of claim 12 wherein said one or more non-imaging sensors are selected from one or more of the following: luster sensors, contrast sensors, brightness sensors, surface sensors, depth sensors, color sensors, laser sensors, 3D sensors and IR/UV sensors.

16. The automatic card shuffling system of claim 12 wherein each automatic playing card shuffler further comprises one or more mirrors positioned to allow said one or more cameras to capture images of card backs, card sides and card faces.

17. The automatic card shuffling system of claim 12 wherein at least one of said one or more cameras have processing power.

18. The automatic card shuffling system of claim 12 wherein said one or more cameras and/or non-imaging sensors are positioned to capture card images and information, respectively, while said cards are moving during said shuffling operation.

19. The automatic card shuffling system of claim 12 wherein said one or more cameras and/or non-imaging sensors are positioned to capture card images and detect information, respectively, while said cards are stationary.

20. The automatic card shuffling system of claim 12 wherein each automatic playing card shuffler further comprises one or more micro-vision systems.

21. The automatic card shuffling device of claim 12 further comprising one or more embedded systems each including a camera, interface and a circuit board.

22. An automatic card shuffling device comprising: a housing; a processor; one or more mechanisms for randomly re-arranging cards from one or more decks of playing cards; one or more micro-vision systems positioned to capture images of each card back and at least a portion of each card thee allowing each card value to be determined during a shuffling operation; one or more databases configured to store card data of said cards captured by said one or more, micro-vision systems; and wherein said processor is configured to compare stored card data captured by said one or more micro-vision systems with newly acquired card data said cards captured by said one or more micro-vision systems to detect anomalies and card markings associated with said cards.

23. The automatic card shuffling device of claim 22 further comprising one or more cameras.

24. The automatic card shuffling device of claim 22 further comprising one or more non-imaging sensors.

25. The automatic card shuffling device of claim 23 wherein said one or more cameras are selected from one or more of the following: area scan cameras, smart cameras, line scan cameras, monochrome cameras, 3D cameras, high speed recording cameras, contact image sensors, board cameras, spectral cameras, color cameras, monochrome cameras and IR/UV cameras.

26. The automatic card shuffling device of claim 24 wherein said one or more non-imaging sensors are selected from one or more of the following: luster sensors, contrast sensors, brightness sensors, surface sensors, depth sensors, color sensors, laser sensors, 3D sensors and IR/UV sensors.

27. The automatic card shuffling device of claim 22 wherein said one or more mechanisms are selected from one or more of the following: rollers, elevators, bins, ejectors, stepper motors and carousels.

28. The automatic card shuffling device of claim 22 further comprising one or more embedded systems each including a camera, interface and a circuit board.

29. An automatic card shuffling device comprising: a housing; a processor; one or more mechanisms for randomly re-arranging cards from one or more decks of playing cards; one or more embedded systems positioned to capture images of at least a portion of each card face allowing each card value to be determined during a shuffling operation and positioned to detect information from each card back during a shuffling operation; one or more databases configured to store card data of said cards captured by said one or more embedded systems: and wherein said processor is configured to compare stored card data captured by said one or more embedded systems with newly acquired card data of said cards captured by said one or more embedded systems to detect anomalies and card markings associated with said cards.

30. The automatic card shuffling device of claim 29 wherein said one or more mechanisms are selected from one or more of the following: rollers, elevators, bins, ejectors, stepper motors and carousels.

31. The automatic card shuffling device of claim 29 further comprising one or more cameras.

32. The automatic card shuffling device of claim 29 further comprising one or more non-imaging sensors.

33. The automatic card shuffling device of claim 31 wherein said one or more cameras are selected from one or more of the following: area scan cameras, smart cameras, line scan cameras, monochrome cameras, 3D cameras, high speed recording cameras, contact image sensors, board cameras, spectral cameras, color cameras, monochrome cameras and IR/UV cameras.

34. The automatic card shuffling device of claim 32 wherein said one or more non-imaging sensors are selected from one or more of the following: luster sensors, contrast sensors, brightness sensors, surface sensors, depth sensors, color sensors, laser sensors, 3D sensors and IR/UV sensors.

35. The automatic card shuffling system of claim 29 further comprising one or more micro-vision systems.

* * * * *